US009240191B2

(12) United States Patent
Grancharov et al.

(10) Patent No.: US 9,240,191 B2
(45) Date of Patent: Jan. 19, 2016

(54) FRAME BASED AUDIO SIGNAL CLASSIFICATION

(75) Inventors: Volodya Grancharov, Solna (SE); Sebastian Näslund, Solna (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 274 days.

(21) Appl. No.: 14/113,616

(22) PCT Filed: Apr. 28, 2011

(86) PCT No.: PCT/EP2011/056761

§ 371 (c)(1), (2), (4) Date: Oct. 24, 2013

(87) PCT Pub. No.: WO2012/146290

PCT Pub. Date: Nov. 1, 2012

(65) Prior Publication Data

US 2014/0046658 A1 Feb. 13, 2014

(51) Int. Cl.
*G10L 19/00* (2013.01)
*G10L 19/02* (2013.01)
(Continued)

(52) U.S. Cl.
CPC ..... *G10L 19/02* (2013.01); *G10L 25/78* (2013.01); *G10L 19/20* (2013.01); *G10L 25/51* (2013.01); *G10L 2025/783* (2013.01)

(58) Field of Classification Search
CPC ..... G10L 25/78; G10L 25/90; G10L 19/22; G10L 2025/783; G10L 2025/786; G10L 25/93; G10L 25/87; G10L 15/02; G10L 19/20; G10L 19/06; G10L 25/00; G10L 25/84; G10L 21/0272; G10L 25/06; G10L 25/51
USPC ..... 704/205–210, 213–218, 277, 278, 704/500–504
See application file for complete search history.

(56) References Cited

U.S. PATENT DOCUMENTS 5,579,435 A * 11/1996 Jansson ..... G10L 19/012 381/56
5,712,953 A 1/1998 Langs
(Continued)

FOREIGN PATENT DOCUMENTS

EP 2 096 629 A1 12/2008
WO WO 98/39768 A1 9/1998
WO WO 02/17299 A1 2/2002

OTHER PUBLICATIONS

Written Opinion of the International Searching Authority, PCT/EP2011/056761, Jan. 12, 2012.
J-H. Chen, A. Gersho, "Adaptive Postfiltering for Quality Enhancement of Coded Speech", IEEE Transactions on Speech and Audio Processing, vol. 3, No. 1, Jan. 1993, pp. 59-71.
(Continued)

*Primary Examiner* — Huyen Vo
(74) *Attorney, Agent, or Firm* — Myers Bigel Sibley & Sajovec, P.A.

(57) ABSTRACT

An audio classifier for frame based audio signal classification includes a feature extractor configured to determine, for each of a predetermined number of consecutive frames, feature measures representing at least the following features: auto correlation, frame signal energy, inter-frame signal energy variation. A feature measure comparator is configured to compare each determined feature measure to at least one corresponding predetermined feature interval. A frame classifier is configured to calculate, for each feature interval, a fraction measure representing the total number of corresponding feature measures that fall within the feature interval, and to classify the latest of the consecutive frames as speech if each fraction measure lies within a corresponding fraction interval, and as non-speech otherwise.

21 Claims, 10 Drawing Sheets

(51) Int. Cl.

| | |
|---|---|
| ***G10L 25/78*** | (2013.01) |
| *G10L 19/20* | (2013.01) |
| *G10L 25/51* | (2013.01) |

(56) References Cited

U.S. PATENT DOCUMENTS

| | | | | |
|---|---|---|---|---|
| 6,640,208 | B1 * | 10/2003 | Zhang | G10L 25/93 704/214 |
| 7,127,392 | B1 | 10/2006 | Smith | |
| 2002/0165713 | A1 * | 11/2002 | Skoglund | G10L 25/78 704/240 |

OTHER PUBLICATIONS

International Search Report, PCT/EP2011/056761, Jan. 12, 2012.

E. Scheirer and M. Slaney, "Construction and Evaluation of a Robust Multifeature Speech/Music Discriminator", ICASSP '97 Proceedings of the 1997 IEEE International Conference on Acoustics, Speech, and Signal Processing, vol. 2, p. 1331-1334, 1997.

K. El-Maleh, M. Klein, G. Petrucci, P. Kabal, "Speech/music discrimination for multimedia applications", available at: http://citeseerx.ist.psu.edu/viewdoc/download?doi=10.1.1.93.3453&rep=rep1&type=pdf.

* cited by examiner

FRAME BASED AUDIO SIGNAL CLASSIFICATION

CROSS REFERENCE TO RELATED APPLICATION

This application is a 35 U.S.C. §371 national stage application of PCT International Application No. PCT/EP2011/056761, filed on 28 Apr. 2011, the disclosure and content of which is incorporated by reference herein in its entirety. The above-referenced PCT International Application was published in the English language as International Publication No. WO 2012/146290 A1 on 1 Nov. 2012.

TECHNICAL FIELD

The present technology relates to frame based audio signal classification.

BACKGROUND

Audio signal classification methods are designed under different assumptions: real-time or off-line approach, different memory and complexity requirements, etc.

For a classifier used in audio coding the decision typically has to be taken on a frame-by-frame basis, based entirely on the past signal statistics. Many audio coding applications, such as real-time coding, also pose heavy constraints on the computational complexity of the classifier.

Reference [1] describes a complex speech/music discriminator (classifier) based on a multidimensional Gaussian maximum a posteriori estimator, a Gaussian mixture model classification, a spatial partitioning scheme based on k-d trees or a nearest neighbor classifier. In order to obtain an acceptable decision error rate it is also necessary to include audio signal features that require a large latency.

Reference [2] describes a speech/music discriminator partially based on Line Spectral Frequencies (LSFs). However, determining LSFs is a rather complex procedure.

Reference [5] describes voice activity detection based on the Amplitude-Modulated (AM) envelope of a signal segment.

SUMMARY

An object of the present technology is low complexity frame based audio signal classification.

This object is achieved in accordance with the attached claims.

A first aspect of the present technology involves a frame based audio signal classification method including the following steps:

- Determine, for each of a predetermined number of consecutive frames, feature measures representing at least the following features: an auto correlation coefficient, frame signal energy on a compressed domain, inter-frame signal energy variation.
- Compare each determined feature measure to at least one corresponding predetermined feature interval.
- Calculate, for each feature interval, a fraction measure representing the total number of corresponding feature measures that fall within the feature interval,
- Classify the latest of the consecutive frames as speech if each fraction measure lies within a corresponding fraction interval, and as non-speech otherwise.

A second aspect of the present technology involves an audio classifier for frame based audio signal classification including:

- A feature extractor configured to determine, for each of a predetermined number of consecutive frames, feature measures representing at least the following features: an auto correlation coefficient, frame signal energy, inter-frame signal energy variation.
- A feature measure comparator configured to compare each determined feature measure to at least one corresponding predetermined feature interval.
- A frame classifier configured to calculate, for each feature interval, a fraction measure representing the total number of corresponding feature measures that fall within the feature interval, and to classify the latest of the consecutive frames as speech if each fraction measure lies within a corresponding fraction interval, and as non-speech otherwise.

A third aspect of the present technology involves an audio encoder arrangement including an audio classifier in accordance with the second aspect to classify audio frames into speech/non-speech and thereby select a corresponding encoding method.

A fourth aspect of the present technology involves an audio codec arrangement including an audio classifier in accordance with the second aspect to classify audio frames into speech/non-speech for selecting a corresponding post filtering method.

A fifth aspect of the present technology involves an audio communication device including an audio encoder arrangement in accordance with the third or fourth aspect.

Advantages of the present technology are low complexity and simple decision logic. These features make it especially suitable for real-time audio coding.

BRIEF DESCRIPTION OF THE DRAWINGS

The technology, together with further objects and advantages thereof, may best be understood by making reference to the following description taken together with the accompanying drawings, in which.

DETAILED DESCRIPTION

In the following description m denotes the audio sample index in a frame and n denotes the frame index. A frame is defined as a short block of the audio signal, e.g. 20-40 ms, containing M samples.

Figure 1:
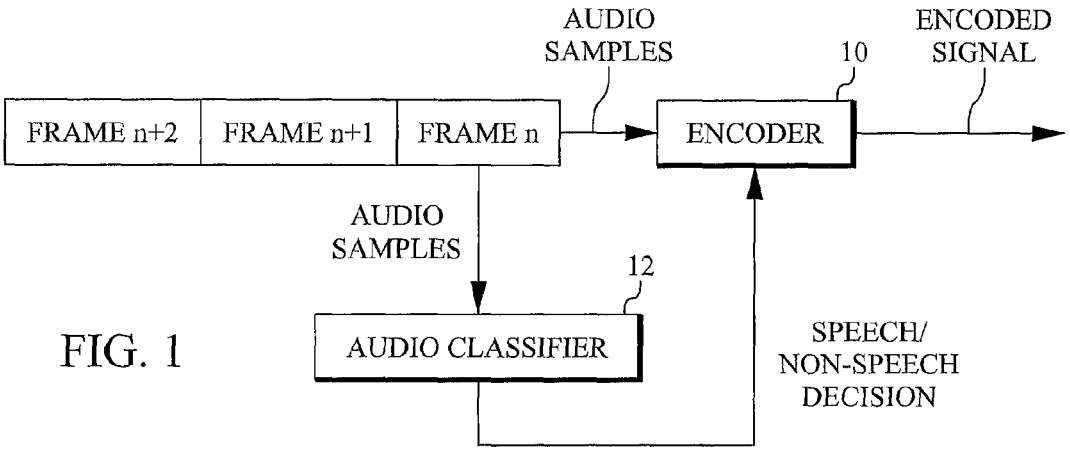
FIG. 1 is a block diagram illustrating an example of an audio encoder arrangement using an audio classifier.

FIG. 1 is a block diagram illustrating an example of an audio encoder arrangement using an audio classifier. Consecutive frames, denoted FRAME n, FRAME n+1, FRAME n+2, . . . , of audio samples are forwarded to an encoder 10, which encodes them into an encoded signal. An audio classifier in accordance with the present technology assists the encoder 10 by classifying the frames into speech/non-speech. This enables the encoder to use different encoding schemes for different audio signal types, such as speech/music or speech/background noise.

The present technology is based on a set of feature measures that can be calculated directly from the signal waveform (or its representation in a frequency domain, as will be described below) at a very low computational complexity.

The following feature measures are extracted from the audio signal on a frame by frame basis:

1. A feature measure representing an auto correlation coefficient between samples $x_m(n)$, preferably the normalized first-order auto correlation coefficient. This feature measure may, for example, be represented by:

$$T_n = \frac{\sum_{m=1}^{M} x_m(n)x_{m-1}(n)}{\sum_{m=2}^{M} x_m^2(n)} \tag{1}$$

2. A feature measure representing frame signal energy on a compressed domain. This feature measure may, for example, be represented by:

$$E_n = 10\cdot\log_{10}\left(\frac{1}{M}\sum_{m=1}^{M} x_m^2(n)\right) \tag{2}$$

where the compression is provided by the logarithm function.

Another example is:

$$E_n = \left(\frac{1}{M}\sum_{m=1}^{M} x_m^2(n)\right)^{\alpha} \tag{3}$$

where $0<\alpha<1$ is a compression factor. A reason for preferring a compressed domain is that this emulates the human auditory system.

3. A feature measure representing frame signal energy variation between adjacent frames. This feature measure may, for example, be represented by:

$$\Delta E_n = \frac{\|E_n - E_{n-1}\|}{E_n + E_{n-1}} \tag{4}$$

The feature measures $T_n$, $E_n$, $\Delta E_n$ are calculated for each frame and used to derive certain signal statistics. First, $T_n$, $E_n$, $\Delta E_n$ are compared to respective predefined criteria (see first two columns in Table 1 below), and the binary decisions for a number of past frames, for example N=40 past frames, are kept in a buffer. Note that some feature measures (for example $T_n$, $E_n$ in Table 1) may be associated with several criteria. Next, signal statistics (fractions) are obtained from the buffered values. Finally, a classification procedure is based on the signal statistics.

TABLE 1

| Parameter | Criterion | Feature Interval | Feature Interval Example | Fraction | Fraction Interval | Fraction Interval Example |
|---|---|---|---|---|---|---|
| $T_n$ | $T_n \le \Theta_1$ | $\{0, \Theta_1\}$ | $\{0, 0.98\}$ | $\Phi_1$ | $\{T_{11}, T_{21}\}$ | $\{0, 0.65\}$ |
| | $T_n \in \{\Theta_2, \Theta_3\}$ | $\{\Theta_2, \Theta_3\}$ | $\{0.8, 0.98\}$ | $\Phi_2$ | $\{T_{12}, T_{22}\}$ | $\{0, 0.375\}$ |
| $E_n$ | $E_n \ge \Theta_4 E_n^{MAX}$ | $\{\Theta_4 E_n^{MAX}, \Omega\}$ | $\{0.62E_n^{MAX}, \Omega\}$ | $\Phi_3$ | $\{T_{13}, T_{23}\}$ | $\{0, 0.975\}$ |
| | $E_n < \Theta_5$ | $\{0, \Theta_5\}$ | $\{0, 42.4\}$ | $\Phi_4$ | $\{T_{14}, T_{24}\}$ | $\{0.025, 1\}$ |
| $\Delta E_n$ | $\Delta E_n > \Theta_6$ | $\{\Theta_6, 1\}$ | $\{0.065, 1\}$ | $\Phi_5$ | $\{T_{15}, T_{25}\}$ | $\{0.075, 1\}$ |

Column 2 of Table 1 describes examples of the different criteria for each feature measure $T_n$, $E_n$, $\Delta E_n$. Although these criteria seem very different at first sight, they are actually equivalent to the feature intervals illustrated in column 3 in Table 1. Thus, in a practical implementation the criteria may be implemented by testing whether the feature measures fall within their respective feature intervals. Example feature intervals are given in column 4 in Table 1.

In Table 1 it is also noted that, in this example, the first feature interval for the feature measure $E_n$ is defined by an auxiliary parameter $E_n^{MAX}$. This auxiliary parameter represents signal maximum and is preferably tracked in accordance with:

$$E_n^{MAX} = (1-\mu)E_{n-1}^{MAX} + \mu E_n \tag{5}$$

$$\mu = \begin{cases} 0.557 & \text{if } E_n \ge E_{n-1}^{MAX} \\ 0.038 & \text{if } E_n < E_{n-1}^{MAX} \\ 0.001 & \text{if } E_n < 0.62E_{n-1}^{MAX} \end{cases}$$

Figure 2:
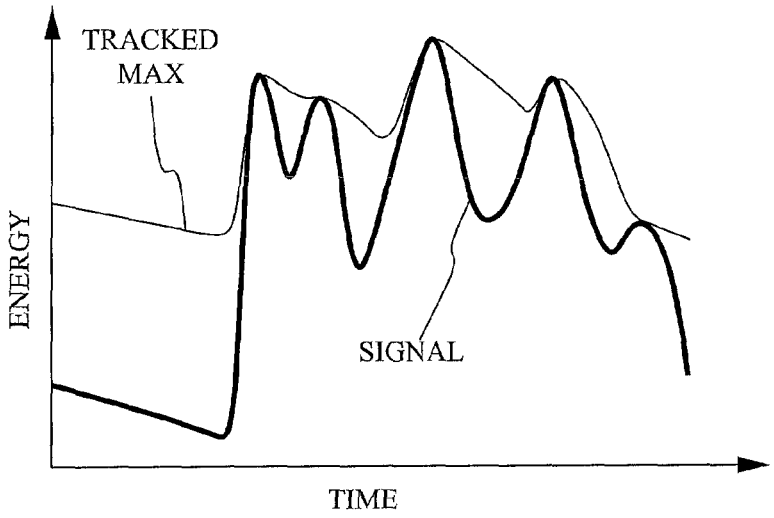
FIG. 2 is a diagram illustrating tracking of energy maximum.

As can be seen from FIG. 2 this tracking algorithm has the property that increases in signal energy are followed immediately, whereas decreases in signal energy are followed only slowly.

An alternative to the described tracking method is to use a large buffer for storing past frame energy values. The length of the buffer should be sufficient to store frame energy values for a time period that is longer than the longest expected pause, e.g. 400 ms. For each new frame the oldest frame energy value is removed and the latest frame energy value is added. Thereafter the maximum value in the buffer is determined.

The signal is classified as speech if all signal statistics (the fractions $\Phi_i$ in column 5 in Table 1) belong to a pre-defined fraction interval (column 6 in Table 1), i.e. $\forall\Phi_i\epsilon\{T_{1i},T_{2i}\}$. An example of fraction intervals is given in column 7 in Table 1. If one or more of the fractions $\Phi_i$ is outside of the corresponding fraction interval $\{T_{1i},T_{2i}\}$, the signal is classified as non-speech.

Figure 3:
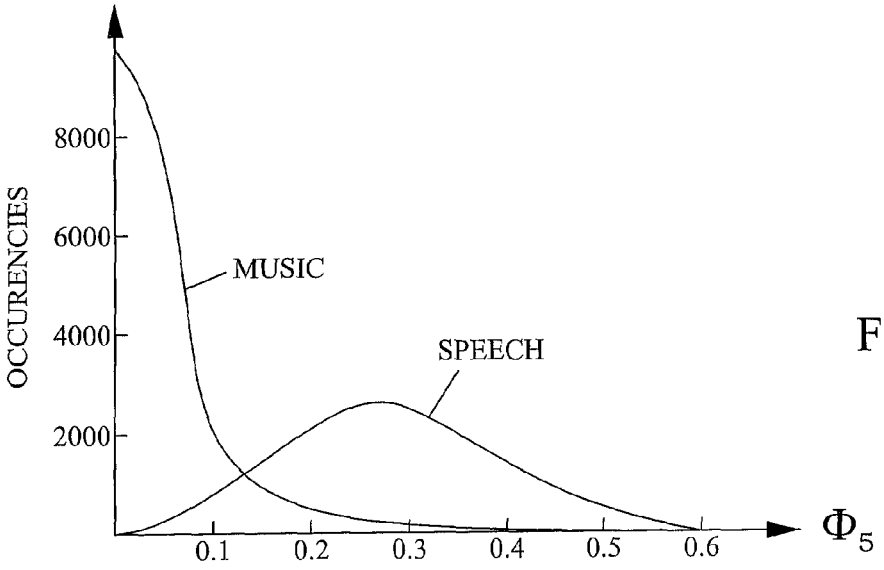
FIG. 3 is a histogram illustrating the difference between speech and music for a specific feature.

The selected signal statistics or fractions $\Phi_i$ are motivated by observations indicating that a speech signal consists of a certain amount of alternating voiced and un-voiced segments. A speech signal can typically also be active only for a limited period of time and is then followed by a silent segment. Energy dynamics or variations are generally larger in a speech signal than in non-speech, such as music, see FIG. 3 which illustrates a histogram of $\Phi_5$ over speech and music databases. A short description of selected signal statistics or fractions $\Phi_i$ is presented in Table 2 below.

TABLE 2

| | |
|---|---|
| $\Phi_1$ | Measures the amount of un-voiced frames in the buffer (an "un-voiced" decision is based on the spectrum tilt, which in turn may be based on an autocorrelation coefficient) |
| $\Phi_2$ | Measures the amount of voiced frames that do not have speech typical spectrum tilt |
| $\Phi_3$ | Measures the amount of active signal frames |
| $\Phi_4$ | Measures the amount of frames belonging to a pause or non-active signal region |
| $\Phi_5$ | Measures the amount of frames with large energy dynamics or variation |

Figure 4:
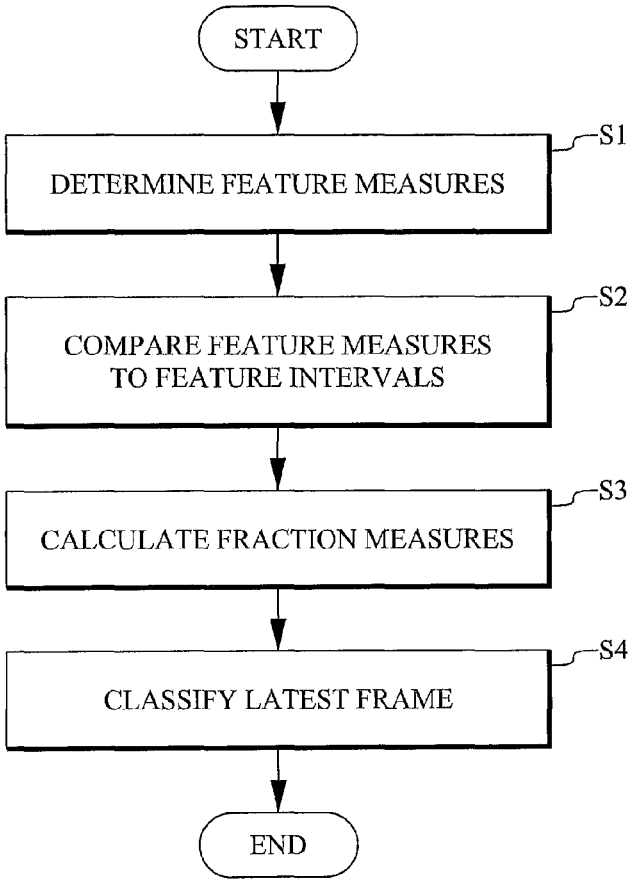
FIG. 4 is flow chart illustrating the present technology.

FIG. 4 is flow chart illustrating the present technology. Step S1 determines, for each of a predetermined number of consecutive frames, feature measures, for example $T_n$, $E_n$, $\Delta E_n$, representing at least the features: auto correlation ($T_n$), frame signal energy ($E_n$) on a compressed domain, inter-frame signal energy variation. Step S2 compares each determined feature measure to at least one corresponding predetermined feature interval. Step S3 calculates, for each feature interval, a fraction measure, for example $\Phi_i$, representing the total number of corresponding feature measures that fall within the feature interval. Step S4 classifies the latest of the consecutive frames as speech if each fraction measure lies within a corresponding fraction interval, and as non-speech otherwise.

Figure 5:
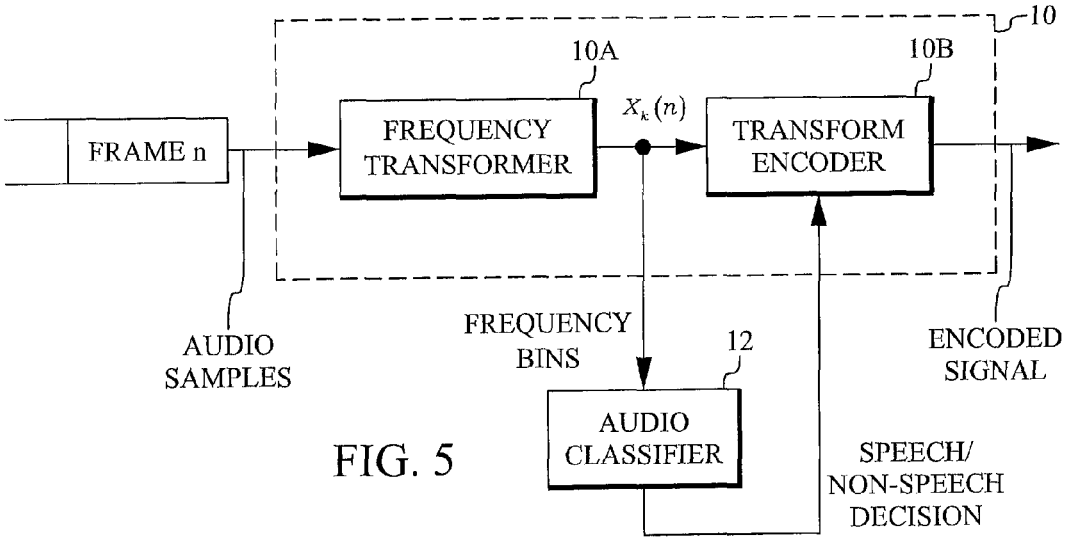
FIG. 5 is a block diagram illustrating another example of an audio encoder arrangement using an audio classifier.

In the examples given above, the feature measures given in (1)-(4) are determined in the time domain. However, it is also possible to determine them in the frequency domain, as illustrated by the block diagram in FIG. 5. In this example audio encoder arrangement the encoder 10 comprises a frequency transformer 10A connected to a transform encoder 10B. The encoder 10 may, for example be based on the Modified Discrete Cosine transform (MDCT). In this case the feature measures $T_n$, $E_n$, $\Delta E_n$ may be determined in the frequency domain from K frequency bins $X_k(n)$ obtained from the frequency transformer 10A. This does not result in any additional computational complexity or delay, since the frequency transformation is required by the transform encoder 10B anyway. In this frequency-domain implementation, equation (1) can be replaced by the ratio between the high and low part of the spectrum:

$$T_n = \frac{\frac{2}{K}\sum_{k=1}^{K/2} X_k^2(n) - \frac{2}{K}\sum_{k=K/2+1}^{K} X_k^2(n)}{\frac{1}{K}\sum_{k=1}^{K} X_k^2(n)} \tag{6}$$

Equations (2) and (3) can be replaced by summation over frequency bins $X_k(n)$ instead of input samples $x_m(n)$, which gives:

$$E_n = 10\cdot\log_{10}\left(\frac{1}{K}\sum_{k=1}^{K} X_k^2(n)\right) \tag{7}$$

and $$E_n = \left(\frac{1}{K}\sum_{k=1}^{K} X_k^2(n)\right)^{\alpha}, \tag{8}$$

respectively.

Similarly, equation (4) may be replaced by:

$$\Delta E_n = \sqrt{\frac{1}{K}\sum_{k=1}^{K} (X_k^2(n) - X_k^2(n-1))^2} \tag{9}$$

or by $$\Delta E_n = \sqrt{\frac{1}{K}\sum_{k=1}^{K} (\log\{X_k^2(n)\} - \log\{X_k^2(n-1)\})^2} \tag{10}$$

The description above has focused on the three feature measures $T_n$, $E_n$, $\Delta E_n$ to classify audio signals. However, further feature measures handled in the same way may be added. One example is a pitch measure (fundamental frequency) $\hat{P}_n$, which can be calculated by maximizing the autocorrelation function:

$$\hat{P}_n = \underset{P}{\operatorname{argmax}}\left(\sum_{m=P+1}^{M} x_m(n)x_{m-P}(n)\right) \tag{11}$$

It is also possible to perform the pitch estimation in the cepstral domain. Cepstral coefficients $c_m(n)$ are obtained through inverse Discrete Fourier Transform (DFT) of log magnitude spectrum. This can be expressed in the following steps: perform a DFT on the waveform vector; on the resulting frequency vector take the absolute value and then the logarithm; finally the Inverse Discrete Fourier Transform (IDFT) gives the vector of cepstral coefficients. The location of the peak in this vector is a frequency domain estimate of the pitch period. In mathematical notation:

$$c_m(n) = IDFT\{\log|DFT\{x_m(n)\}|\} \tag{12}$$

$$\hat{P}_n = \underset{P}{\operatorname{argmax}}(c_P(n))$$

Figure 6:
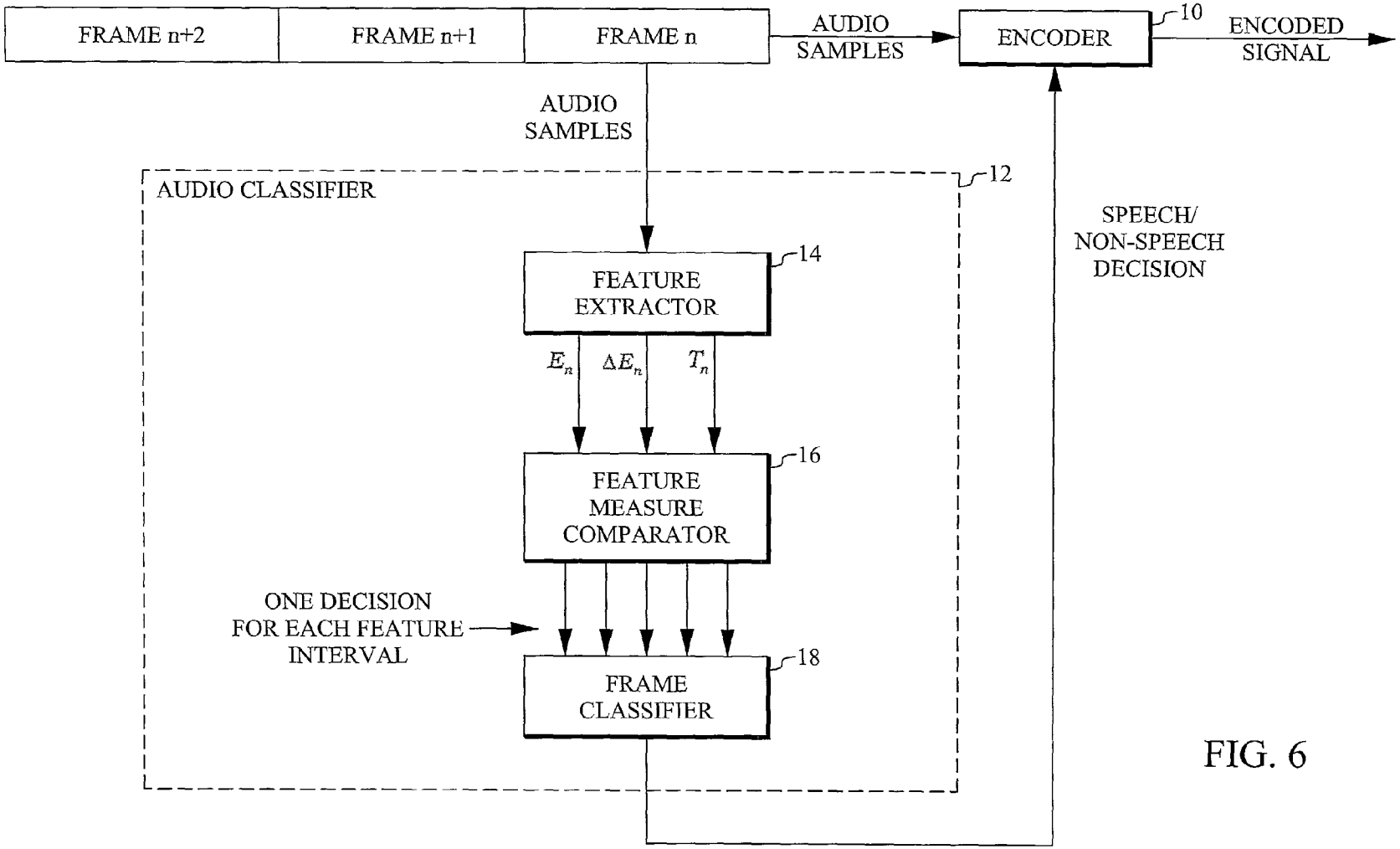
FIG. 6 is a block diagram illustrating an example embodiment of an audio classifier.

FIG. 6 is a block diagram illustrating an example embodiment of an audio classifier. This embodiment is a time domain implementation, but it could also be implemented in the frequency domain by using frequency bins instead of audio samples. In the embodiment in FIG. 6 the audio classifier 12 includes a feature extractor 14, a feature measure comparator 16 and a frame classifier 18. The feature extractor 14 may be configured to implement the equations described above for determining at least $T_n$, $E_n$, $\Delta E_n$. The feature measure comparator 16 is configured to compare each determined feature measure to at least one corresponding predetermined feature interval. The frame classifier 18 is configured to calculate, for each feature interval, a fraction measure representing the total number of corresponding feature measures that fall within the feature interval, and to classify the latest of the consecutive frames as speech if each fraction measure lies within a corresponding fraction interval, and as non-speech otherwise.

Figure 7:
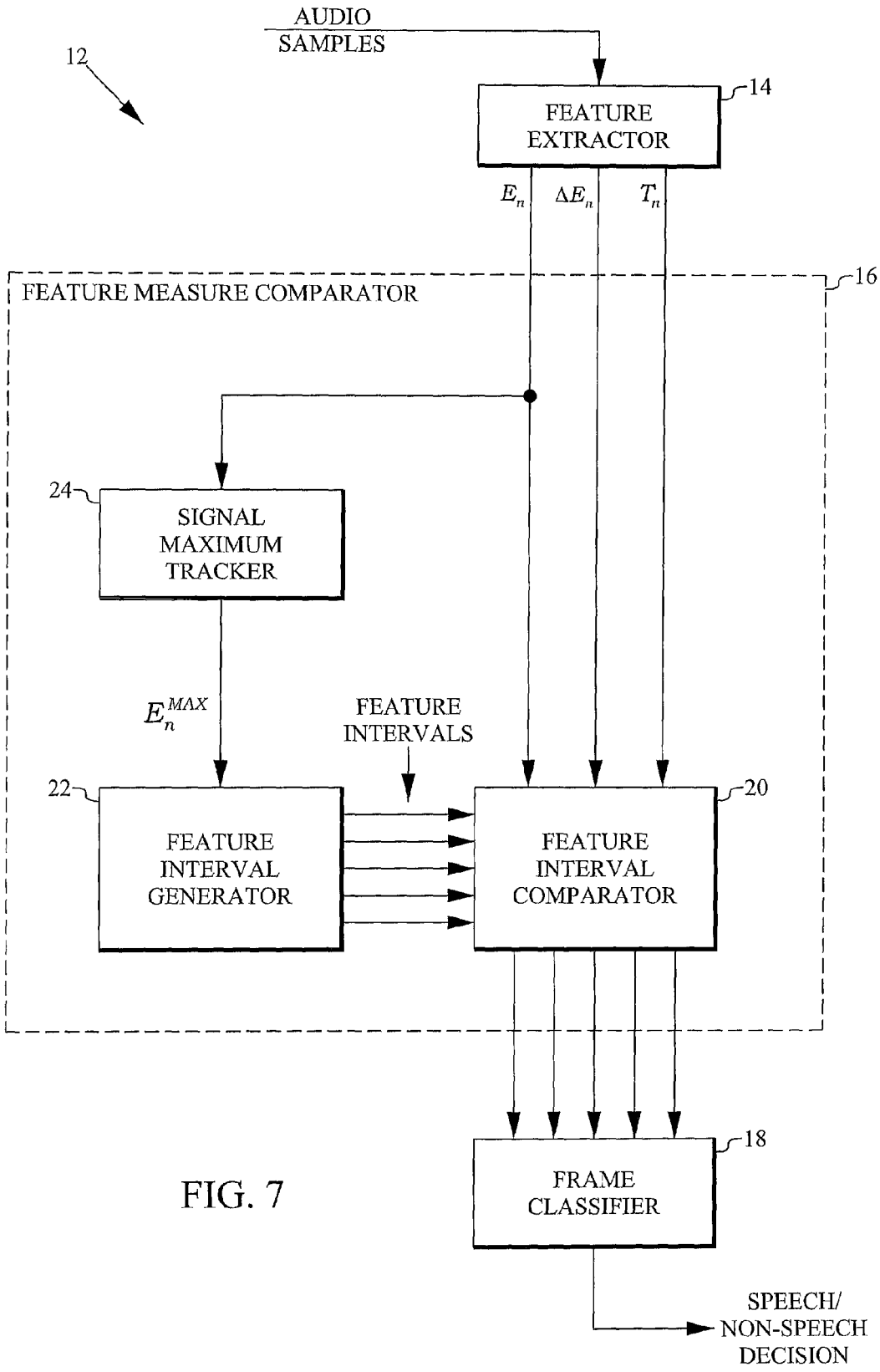
FIG. 7 is a block diagram illustrating an example embodiment of a feature measure comparator in the audio classifier of FIG. 6.

FIG. 7 is a block diagram illustrating an example embodiment of the feature measure comparator 16 in the audio classifier 12 of FIG. 6. A feature interval comparator 20 receiving the extracted feature measures, for example $T_n$, $E_n$, $\Delta E_n$, is configured to determine whether the feature measures lie within predetermined feature intervals, for example the intervals given in Table 1 above. These feature intervals are obtained from a feature interval generator 22, for example implemented as a lookup table. The feature interval that depends on the auxiliary parameter $E_n^{MAX}$ is obtained by updating the lookup table with $E_n^{MAX}$ for each new frame. The value $E_n^{MAX}$ is determined by a signal maximum tracker 24 configured to track the signal maximum, for example in accordance with equation (5) above.

Figure 8:
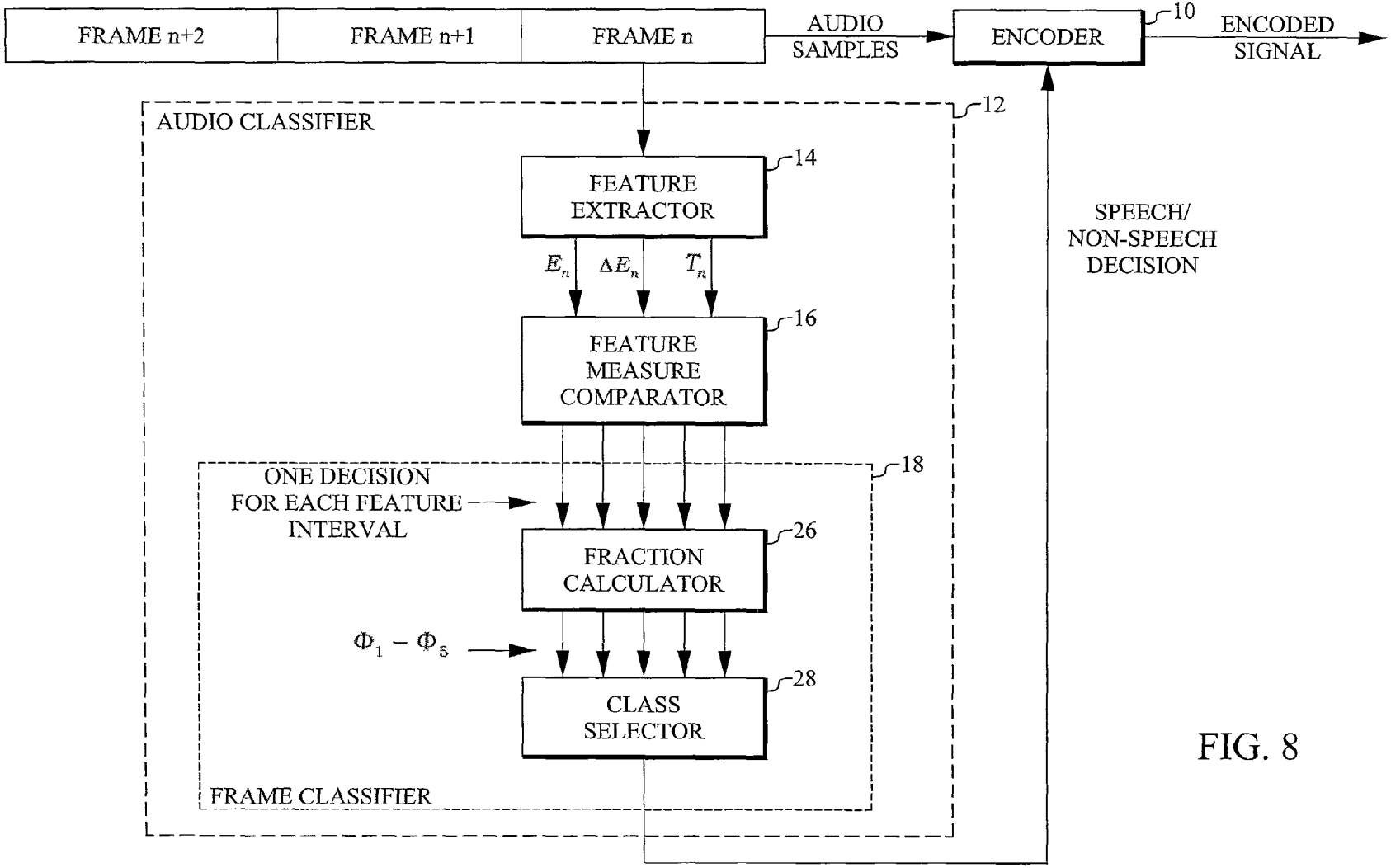
FIG. 8 is a block diagram illustrating an example embodiment of a frame classifier in the audio classifier of FIG. 6.
Figure 9:
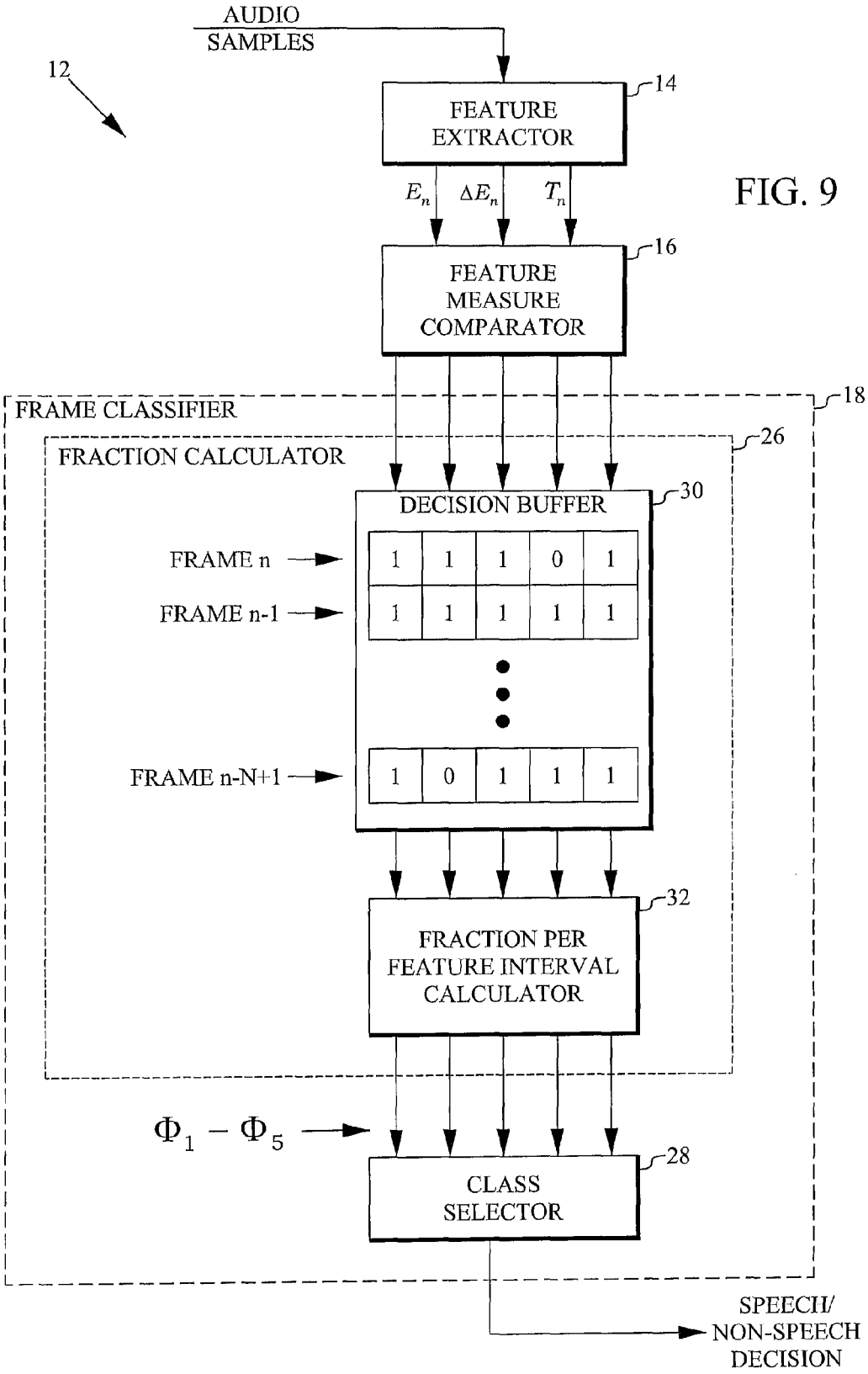
FIG. 9 is a block diagram illustrating an example embodiment of a fraction calculator in the frame classifier of FIG. 8.

FIG. 8 is a block diagram illustrating an example embodiment of a frame classifier 18 in the audio classifier 12 of FIG. 6. A fraction calculator 26 receives the binary decisions (one decision for each feature interval) from the feature measure comparator 16 and is configured to calculate, for each feature interval, a fraction measure (in the example $\Phi_1$-$\Phi_5$) representing the total number of corresponding feature measures that fall within the feature interval. An example embodiment of the fraction calculator 26 is illustrated in FIG. 9. These fraction measures are forwarded to a class selector 28 configured to classify the latest audio frame as speech if each fraction measure lies within a corresponding fraction interval, and as non-speech otherwise. An example embodiment of the class selector 28 is illustrated in FIG. 10.

FIG. 9 is a block diagram illustrating an example embodiment of a fraction calculator 26 in the frame classifier 18 of FIG. 8. The binary decisions from the feature measure comparator 16 are forwarded to a decision buffer 30, which stores the latest N decisions for each feature interval. A fraction per feature interval calculator 32 determines each fraction measure by counting the number of decisions for the corresponding feature that indicate speech and dividing this count by the total number of decisions N. An advantage of this embodiment is that the decision buffer only has to store binary decisions, which makes the implementation simple and essentially reduces the fraction calculation to a simple counting process.

Figure 10:
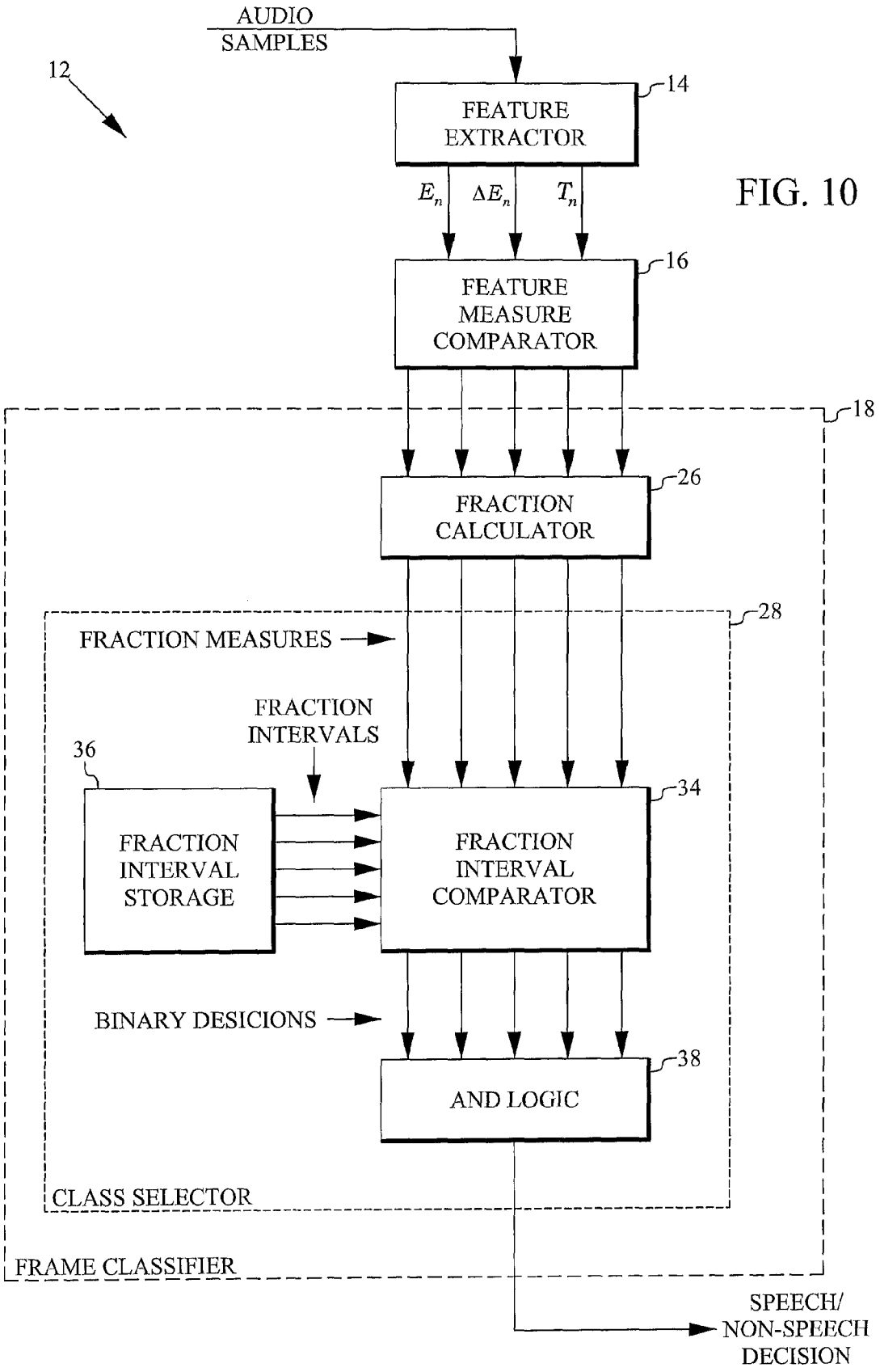
FIG. 10 is a block diagram illustrating an example embodiment of a class selector in the frame classifier of FIG. 8.

FIG. 10 is a block diagram illustrating an example embodiment of a class selector 28 in the frame classifier 18 of FIG. 8. The fraction measures from the fraction calculator 26 are forwarded to a fraction interval calculator 34, which is configured to determine whether each fraction measure lies within a corresponding fraction interval, and to output a corresponding binary decision. The fraction intervals are obtained from a fraction interval storage 36, which stores, for example, the fraction intervals in column 7 in Table 1 above. The binary decisions from the fraction interval calculator 34 are forwarded to an AND logic 38, which is configured to classify the latest frame as speech if all them indicate speech, and as non-speech otherwise.

The steps, functions, procedures and/or blocks described herein may be implemented in hardware using any conventional technology, such as discrete circuit or integrated circuit technology, including both general-purpose electronic circuitry and application-specific circuitry.

Alternatively, at least some of the steps, functions, procedures and/or blocks described herein may be implemented in software for execution by a suitable processing device, such as a micro processor, Digital Signal Processor (DSP) and/or any suitable programmable logic device, such as a Field Programmable Gate Array (FPGA) device.

It should also be understood that it may be possible to reuse the general processing capabilities of the encoder. This may, for example, be done by reprogramming of the existing software or by adding new software components.

Figure 11:
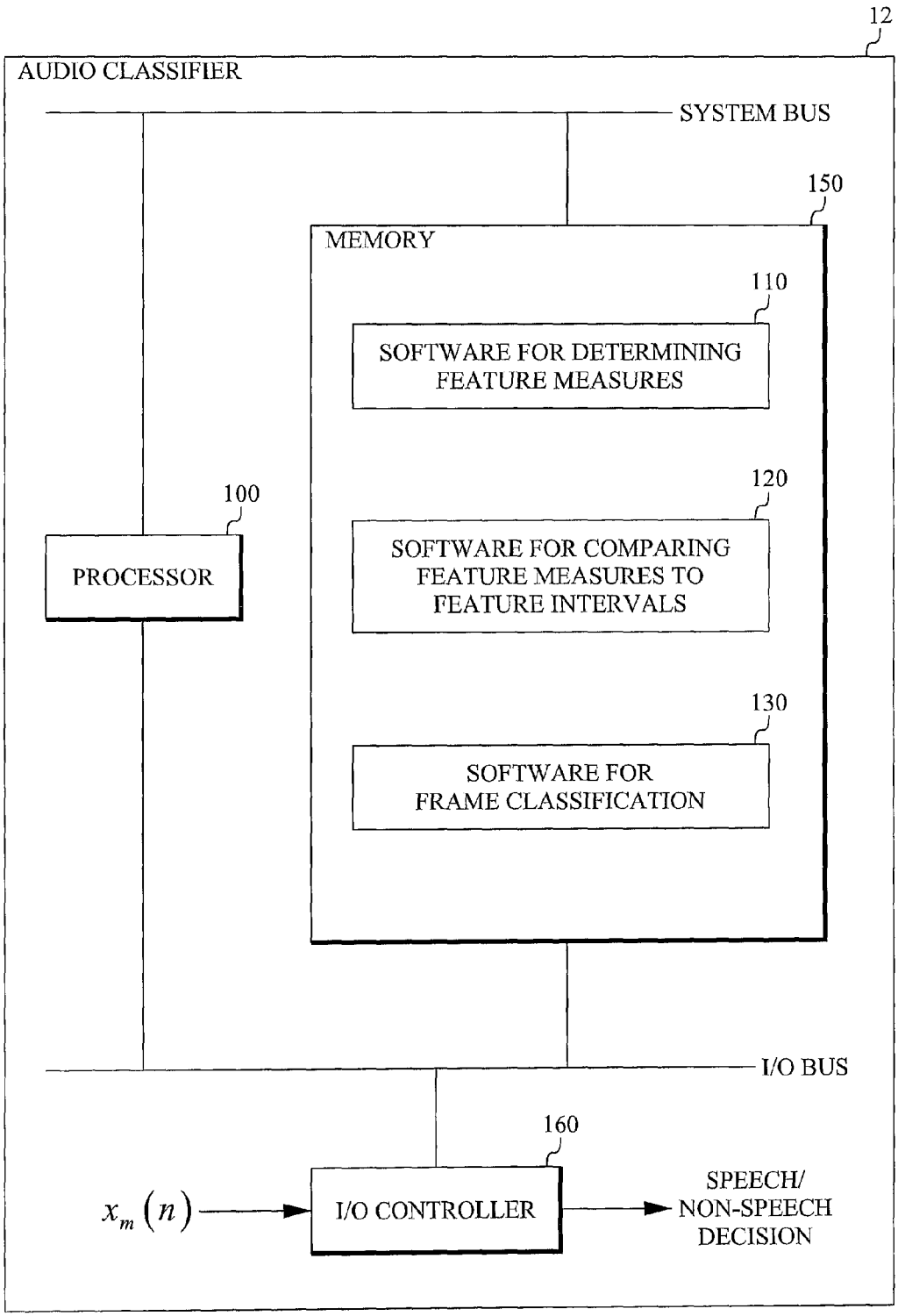
FIG. 11 is a block diagram of an example embodiment of an audio classifier.

FIG. 11 is a block diagram of an example embodiment of an audio classifier 12. This embodiment is based on a processor 100, for example a micro processor, which executes a software component 110 for determining feature measures, a software component 120 for comparing feature measures to feature intervals, and a soft-ware component 130 for frame classification. These software components are stored in memory 150. The processor 100 communicates with the memory over a system bus. The audio samples $x_m(n)$ are received by an input/output (I/O) controller 160 controlling an I/O bus, to which the processor 100 and the memory 150 are connected. In this embodiment the samples received by the I/O controller 160 are stored in the memory 150, where they are processed by the software components. Software component 110 may implement the functionality of block 14 in the embodiments described above. Software component 120 may implement the functionality of block 16 in the embodiments described above. Software component 130 may implement the functionality of block 18 in the embodiments described above. The speech/non-speech decision obtained from software component 130 is outputted from the memory 150 by the I/O controller 160 over the I/O bus.

Figure 12:
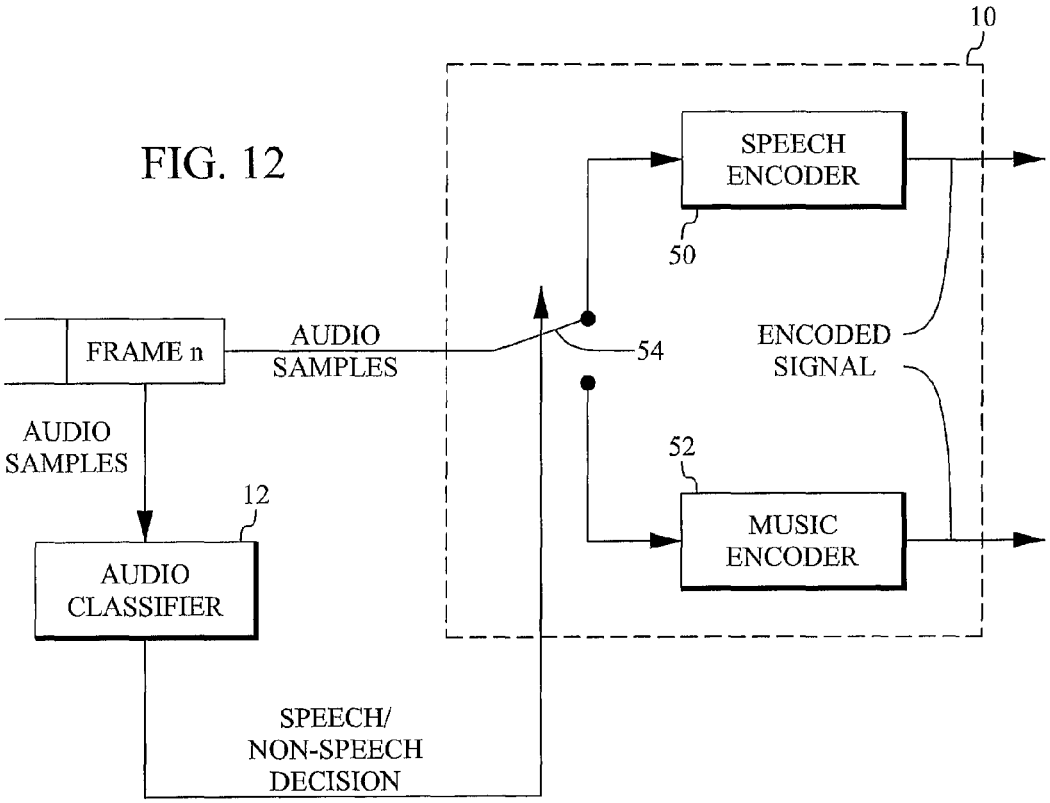
FIG. 12 is a block diagram illustrating another example of an audio encoder arrangement using an audio classifier.

FIG. 12 is a block diagram illustrating another example of an audio encoder arrangement using an audio classifier 12. In this embodiment the encoder 10 comprises a speech encoder 50 and a music encoder 52. The audio classifier controls a switch 54 that directs the audio samples to the appropriate encoder 50 or 52.

Figure 13:
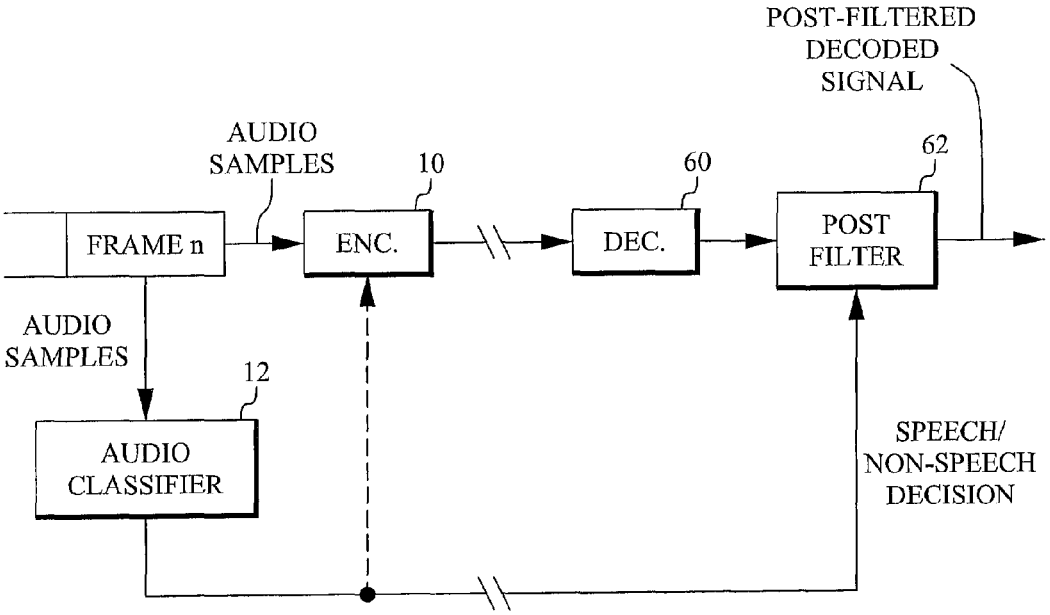
FIG. 13 is a block diagram illustrating an example of an audio codec arrangement using a speech/non-speech decision from an audio classifier 12.

FIG. 13 is a block diagram illustrating an example of an audio codec arrangement using a speech/non-speech decision from an audio classifier 12. This embodiment uses a post filter 60 for speech enhancement. Post filtering is described in [3] and [4]. In this embodiment the speech/non-speech decision from the audio classifier 12 is transmitted to a receiving side along with the encoded signal from the encoder 10. The encoded signal is decoder in a decoder 60 and the decoded signal is post filtered in a post filter 62. The speech/non-speech decision is used to select a corresponding post filtering method. In addition to selecting a post filtering method the speech/non-speech decision may also be used to select the encoding method, as indicated by the dashed line to the encoder 10.

Figure 14:
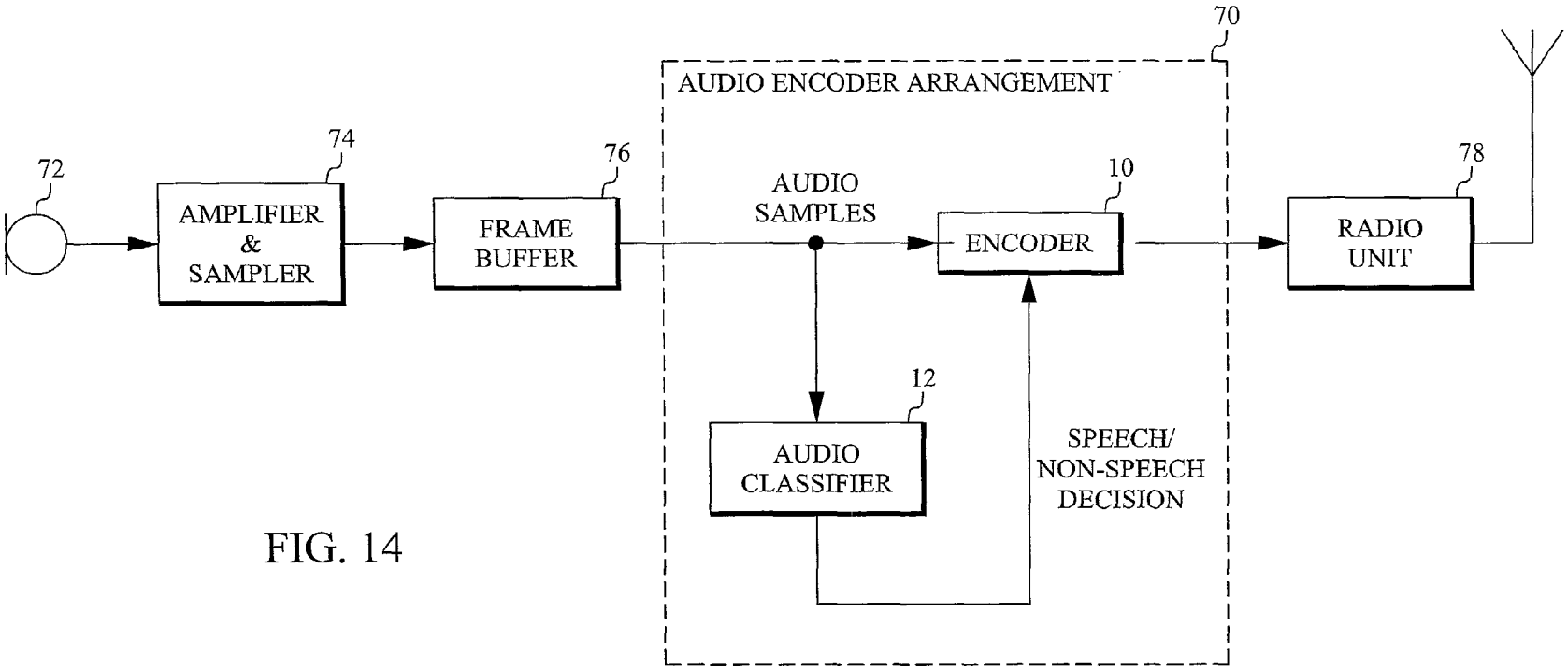
FIG. 14 is a block diagram illustrating an example of an audio communication device using an audio encoder arrangement.

FIG. 14 is a block diagram illustrating an example of an audio communication device using an audio encoder arrangement in accordance with the present technology. The figure illustrates an audio encoder arrangement 70 in a mobile station. A microphone 72 is connected to an amplifier and sampler block 74. The samples from block 74 are stored in a frame buffer 76 and are forwarded to the audio encoder arrangement 70 on a frame-by-frame basis. The encoded signals are then forwarded to a radio unit 78 for channel coding, modulation and power amplification. The obtained radio signals are finally transmitted via an antenna.

Although most of the example embodiments above have been illustrated in the time domain, it is appreciated that they may also be implemented in the frequency domain, for example for transform coders. In this case the feature extractor 14 will be based on, for example, some of the equations (6)-(10). However, once the feature measures have been determined, the same elements as in the time domain implementations may be used.

With an embodiment based on equations (1), (2), (4), (5) and Table 1, the following performance was obtained for audio signal classification:

| | |
|---|---|
| % speech erroneously classified as music | 5.9 |
| % music erroneously classified as speech | 1.8 |

The audio classification described above is particularly suited for systems that transmit encoded audio signals in real-time. The information provided by the classifier can be used to switch between types of coders (e.g., a Code-Excited Linear Prediction (CELP) coder when a speech signal is detected and a transform coder, such as a Modified Discrete Cosine Transform (MDCT) coder when a music signal is detected), or coder parameters. Furthermore, classification decisions can also be used to control active signal specific processing modules, such as speech enhancing post filters.

However, the described audio classification can also be used in off-line applications, as a part of a data mining algorithm, or to control specific speech/music processing modules, such as frequency equalizers, loudness control, etc.

It will be understood by those skilled in the art that various modifications and changes may be made to the present technology without departure from the scope thereof, which is defined by the appended claims.

REFERENCES

[1] E. Scheirer and M. Slaney, "Construction and Evaluation of a Robust Multifeature Speech/Music Discriminator", ICASSP '97 Proceedings of the 1997 IEEE International Conference on Acoustics, Speech, and Signal Processing, Volume 2, page 1331-1334, 1997

[2] K. El-Maleh, M. Klein, G. Petrucci, P. Kabal, "Speech/music discrimination for multimedia applications", available at: http://citeseerx.ist.psu.edu/viewdoc/download?doi=10.1.1.93.3453&rep=rep1&type=pdf

[3] J-H. Chen, A. Gersho, "Adaptive Postfiltering for Quality Enhancement of Coded Speech", IEEE Transactions on Speech and Audio Processing, Vol. 3, No. 1, January 1993, page 59-71

[4] WO 98/39768 A1

[5] U.S. Pat. No. 7,127,392 B1

ABBREVIATIONS

CELP Code-Excited Linear Prediction
DFT Discrete Fourier Transform
DSP Digital Signal Processor
FPGA Field Programmable Gate Array
IDFT Inverse Discrete Fourier Transform
LSFs Line Spectral Frequencies
MDCT Modified Discrete Cosine Transform

The invention claimed is:

1. A frame based audio signal classification method, comprising the steps of:

determining, for each of a predetermined number of consecutive frames, feature measures representing at least the following features:

an auto correlation coefficient, frame signal energy ($E_n$) on a compressed domain emulating the human auditory system, and inter-frame signal energy variation;

comparing each determined feature measure to at least one corresponding predetermined feature interval;

calculating, for each feature interval, a fraction measure ($\Phi_1$-$\Phi_5$) representing the total number of corresponding feature measures ($T_n$, $E_n$, $\Delta E_n$) that fall within the feature interval; and classifying the latest of the consecutive frames as speech based on each fraction measure lying within a corresponding fraction interval, and classifying the latest of the consecutive frames as non-speech based on each fraction measure not lying within the corresponding fraction interval.

2. The method of claim 1, wherein the feature measures representing the auto correlation coefficient ($T_n$) and frame signal energy ($E_n$) on the compressed domain are determined in the time domain.

3. The method of claim 2, wherein the feature measure representing the auto correlation coefficient is determined based on:

$$T_n = \frac{\sum_{m=1}^{M} x_m(n)x_{m-1}(n)}{\sum_{m=2}^{M} x_m^2(n)}$$

where $x_m(n)$ denotes sample m in frame n,

M is the total number of samples in each frame.

4. The method of claim 2, wherein the feature measure representing frame signal energy on the compressed domain is determined based on:

$$E_n = 10\log_{10}\left(\frac{1}{M}\sum_{m=1}^{M} x_m^2(n)\right)$$

where $x_m(n)$ denotes sample m,

M is the total number of samples in a frame.

5. The method of claim 1, wherein the feature measures representing the auto correlation coefficient ($T_n$) and frame signal energy ($E_n$)) on the compressed domain are determined in the frequency domain.

6. The method of claim 1, wherein the feature measure representing frame signal energy variation between adjacent frames is determined based on:

$$\Delta E_n = \frac{\|E_n - E_{n-1}\|}{E_n + E_{n-1}}$$

where $E_n$ represents the frame signal energy on the compressed domain in frame n.

7. The method of claim 1, further comprising the step of determining a further feature measure representing inter-frame spectral variation ($SD_n$).

8. The method of claim 1, further comprising the step of determining a further feature measure representing fundamental frequency ($\hat{P}$).

9. The method of claim 1, wherein a feature interval corresponding to frame signal energy ($E_n$) on the compressed domain is determined based on $\{0.62E_n^{MAX}, \Omega\}$, where $\Omega$ is an upper energy limit and $E_n^{MAX}$ is an auxiliary parameter determined based on:

$$E_n^{MAX} = (1-\mu)E_{n-1}^{MAX} + \mu E_n$$

$$\mu = \begin{cases} 0.557 & \text{if } E_n \geq E_{n-1}^{MAX} \\ 0.038 & \text{if } E_n < E_{n-1}^{MAX} \\ 0.001 & \text{if } E_n < 0.62E_{n-1}^{MAX} \end{cases}$$

where $E_n$ represents the frame signal energy on the compressed domain in frame n.

10. An audio classifier for frame based audio signal classification, comprising:

a memory storing software components; and a processor configured to execute the software components from the memory, the software components comprising:

a feature extractor configured to determine, for each of a predetermined number of consecutive frames, feature measures representing at least the following features:

an auto correlation coefficient ($T_n$), frame signal energy ($E_n$) on a compressed domain emulating the human auditory system, and inter-frame signal energy variation;

a feature measure comparator configured to compare each determined feature measure ($T_n$, $E_n$, $\Delta E_n$) to at least one corresponding predetermined feature interval;

a frame classifier configured to calculate, for each feature interval, a fraction measure ($\Phi_1$-$\Phi_5$) representing the total number of corresponding feature measures that fall within the feature interval, and to classify the latest of the consecutive frames as speech based on each fraction measure lies within a corresponding fraction interval, and to classify the latest of the consecutive frames as non-speech based on each fraction measure not lying within the corresponding fraction interval.

11. The audio classifier of claim 10, wherein the feature extractor is configured to determine the feature measures representing frame signal energy ($E_n$) on the compressed domain and the auto correlation coefficient ($T_n$) in the time domain.

12. The audio classifier of claim 11, wherein the feature extractor is configured to determine the feature measure representing the auto correlation coefficient based on:

$$T_n = \frac{\sum_{m=1}^{M} x_m(n)x_{m-1}(n)}{\sum_{m=2}^{M} x_m^2(n)}$$

where $x_m(n)$ denotes sample m in frame n,

M is the total number of samples in each frame.

13. The audio classifier of claim 11, wherein the feature extractor is configured to determine the feature measure representing frame signal energy on the compressed domain based on:

$$E_n = 10\log_{10}\left(\frac{1}{M}\sum_{m=1}^{M} x_m^2(n)\right)$$

where $x_m(n)$ denotes sample m,

M is the total number of samples in a frame.

14. The audio classifier of claim 10, wherein the feature extractor is configured to determine the feature measures representing frame signal energy ($E_n$) on the compressed domain and the auto correlation coefficient ($T_n$) in the frequency domain.

15. The audio classifier of claim 10, wherein the feature extractor is configured to determine the feature measure representing inter-frame signal energy variation based on:

$$\Delta E_n = \frac{\|E_n - E_{n-1}\|}{E_n + E_{n-1}}$$

where $E_n$ represents the frame signal energy on the compressed domain in frame n.

16. The audio classifier of claim 10, wherein the feature extractor is configured to determine a further feature measure representing fundamental frequency ($\hat{P}$).

17. The audio classifier of claim 10, wherein the feature measure comparator is configured to generate a feature interval $\{0.62E_n^{MAX}, \Omega\}$ corresponding to frame signal energy ($E_n$) on the compressed domain, where $\Omega$ is an upper energy limit and $E_n^{MAX}$ is an auxiliary parameter determined based on:

$$E_n^{MAX} = (1-\mu)E_{n-1}^{MAX} + \mu E_n$$

$$\mu = \begin{cases} 0.557 & \text{if } E_n \geq E_{n-1}^{MAX} \\ 0.038 & \text{if } E_n < E_{n-1}^{MAX} \\ 0.001 & \text{if } E_n < 0.62E_{n-1}^{MAX} \end{cases}$$

where $E_n$ represents the frame signal energy on the compressed domain in frame n.

18. The audio classifier of claim 10, wherein the frame classifier includes a fraction calculator configured to calculate, for each feature interval, a fraction measure ($\Phi_1$-$\Phi_5$) representing the total number of corresponding feature measures that fall within the feature interval;

a class selector configured to classify the latest of the consecutive frames as speech if each fraction measure lies within a corresponding fraction interval, and as non-speech otherwise.

19. The audio classifier of claim 10, wherein the audio classifier is within an audio encoder arrangement.

20. The audio classifier of claim 19, wherein the audio encoder arrangement is within an audio communication device.

21. The audio classifier of claim 10, wherein the audio classifier is within an audio codec arrangement.

* * * * *